US009198554B2

(12) United States Patent
Boulton et al.

(10) Patent No.: US 9,198,554 B2
(45) Date of Patent: Dec. 1, 2015

(54) FLUID DELIVERY SERVICE

(75) Inventors: Jill Boulton, Edinburgh (GB); Alan Boulton, Edinburgh (GB)

(73) Assignee: Visual Products Limited, Edinburgh (GB)

( * ) Notice: Subject to any disclaimer, the term of this patent is extended or adjusted under 35 U.S.C. 154(b) by 234 days.

(21) Appl. No.: 13/991,639

(22) PCT Filed: Dec. 2, 2011

(86) PCT No.: PCT/GB2011/052389

§ 371 (c)(1),
(2), (4) Date: Jul. 3, 2013

(87) PCT Pub. No.: WO2012/076865

PCT Pub. Date: Jun. 14, 2012

(65) Prior Publication Data

US 2013/0269136 A1 Oct. 17, 2013

(30) Foreign Application Priority Data

Dec. 8, 2010 (GB) ..... 1020781.9

(51) Int. Cl.

| | |
|---|---|
| ***A47L 13/19*** | (2006.01) |
| ***A41D 19/015*** | (2006.01) |
| ***A42B 3/26*** | (2006.01) |
| ***A47L 1/08*** | (2006.01) |
| ***A47L 25/00*** | (2006.01) |

(52) U.S. Cl.

CPC ..... *A47L 13/19* (2013.01); *A41D 19/01594* (2013.01); *A42B 3/26* (2013.01); *A47L 1/08* (2013.01); *A47L 25/00* (2013.01)

(58) Field of Classification Search

CPC combination set(s) only.
See application file for complete search history.

(56) References Cited

U.S. PATENT DOCUMENTS

| | | | | |
|---|---|---|---|---|
| 2,061,219 | A * | 11/1936 | Wright | 401/7 |
| 2,663,890 | A * | 12/1953 | Sullins | 401/7 |
| 3,701,604 | A | 5/1970 | Holroyd | |
| 4,652,163 | A * | 3/1987 | Karliner et al. | 401/195 |
| 4,953,998 | A | 9/1990 | McCartherens | |
| 5,328,283 | A * | 7/1994 | Viens | 401/23 |
| 6,386,781 | B1 * | 5/2002 | Gueret | 401/198 |
| 7,125,189 | B2 * | 10/2006 | Gueret | 401/202 |
| 8,469,619 | B1 * | 6/2013 | Lewis et al. | 401/7 |
| 2009/0154895 | A1 | 6/2009 | Taoka | |

FOREIGN PATENT DOCUMENTS

| | | |
|---|---|---|
| DE | 10064863 | 7/2002 |
| GB | 2362557 | 11/2001 |

OTHER PUBLICATIONS

International Search Report dated Feb. 20, 2012.

* cited by examiner

*Primary Examiner* — David Walczak
(74) *Attorney, Agent, or Firm* — Brinks Gilson & Lione

(57) ABSTRACT

A fluid delivery device (3) for a visor cleaner. The fluid delivery device (3) includes a fluid reservoir (7), which contains cleaning fluid when ready for use. The fluid delivery device (3) also includes an absorbent cleaning element (13) that is arranged to take in fluid from the reservoir (7). In use, the fluid in the reservoir (7) and the absorbent cleaning element (13) are arranged to be in permanent fluid communication.

15 Claims, 8 Drawing Sheets

FLUID DELIVERY SERVICE

CROSS-REFERENCE TO RELATED APPLICATIONS

This application is a claims priority to International Application Number PCT/GB2011/052389, filed Dec. 2, 2011 which claims priority to Great Britain Application Number 1020781.9, filed Dec. 8, 2010.

FIELD OF INVENTION

This invention relates to a fluid delivery device. More particularly, the present invention relates to a fluid delivery device worn on a user's hand for use as a motorcycle visor cleaner.

BACKGROUND

Motorcyclists often experience impairment to visibility due to rain, mud, road salt, dust or debris caused by, for example insects impacting on the visor of their helmets. Attempts to remove dust or debris from the visor could result in smearing across the visor, which may lead to further impaired visibility through the visor.

Conventional products are available for cleaning visors of motorcycle helmets, but generally these are employed whilst the motorcyclist is stationary. However, on occasion the motorcyclist may need to clean the visor whilst moving to improve visibility. In extreme situations, this may need to be done very quickly to avoid an accident.

US 2009/0158495 (FLYNN) discloses a glove for a motorcyclist wearing a helmet with a visor. The glove includes a layer of flexible material attached in the region of the index finger and the thumb. The glove also includes a flexible pouch containing cleaning fluid. The flexible pouch is positioned in a compartment in the region of the cuff of the glove. A fluid conduit connects the flexible material to the flexible pouch and includes a check valve such that on compressing the pouch the valve allows fluid to pass from the pouch to the flexible material. When the flexible material is primed with cleaning fluid it can be used to wipe or clean debris from the visor.

DE 10 064 863 (DEGEN BERND) discloses a device that has a cleaning fluid tank, and a cleaning element with a cleaning surface. Two separate embodiments are described. In the first embodiment, cleaning fluid is supplied from the tank by an atomiser to the visor and in the second embodiment a cleaning fluid is provided by a fluid conveyed from the tank to the cleaning element by pressing on the surface of the cleaning element, which acts against a compression spring to allow fluid to be released from the tank into the cleaning element. In both embodiments the cleaning fluid tank and fluid feeder are arranged as a modular unit that is shaped for fastening to a protective glove or to the lower arm of a driver. In each embodiment, the device is operated by movements of the arm.

In the cleaning devices of the prior art the user needs to physically pump fluid into the cleaning element whilst their hand is removed from the handle bar. Therefore, there is a time period during which visibility is impaired whilst the user primes the cleaning element with cleaning fluid, or in the case of the first embodiment of DE 10 064 863 when the user has sprayed the visor; hence impairing visibility further. The time period may be very short, but this period of time may be particularly significant in a situation when on a moving motorcycle. This is particularly significant when, for example travelling on a motorway, where it is not possible just to stop suddenly, and being unable to see properly through the visor.

It is desirable to provide an improved fluid delivery device.

It is also desirable to provide a fluid delivery device that substantially reduces the time required by the driver/rider to remove his hand from the handle bar of the motorcycle.

It is further desirable to provide a fluid delivery device that reduces the number of steps or actions required by the user.

It is further desirable to provide a fluid delivery device and hence a visor cleaner that quickly, simply and safely cleans a visor in single action.

SUMMARY OF THE INVENTION

In accordance with a first aspect of the present invention there is provided a fluid delivery device to be worn on a user's hand for a visor cleaner, the fluid delivery device comprising:

- a fluid reservoir adapted, in use, to contain fluid;
- an absorbent cleaning element arranged to absorb fluid from the fluid reservoir;
- wherein the absorbent cleaning element is in permanent fluid communication with fluid contained in the fluid reservoir.

The phrase permanent fluid communication means that during normal use fluid communication between the absorbent cleaning element and the fluid in the fluid reservoir is automatic and is regardless of the action of the user.

The first aspect of the present invention therefore relates to a fluid delivery device that is arranged to be worn by a user and may be used to clean a motorcycle helmet visor, although other applications are possible. The fluid delivery device may simply include a reservoir of fluid and a cleaning element where transfer of fluid from the fluid reservoir to the cleaning element may be by capillary action. The first aspect of the present invention therefore allows for effective cleaning of a visor without the need for additional valves or actions by the user to ensure that cleaning fluid is applied to the cleaning element.

The fluid delivery device is adapted such that a single sweeping action may be capable of cleaning a visor swiftly and efficiently. Thus the period of impaired visibility is greatly reduced compared with prior art devices that require additional actions by the user to apply cleaning fluid to the visor and subsequently remove the fluid. Any reduction in the period of impaired visibility is a marked improvement because the visor provides the line of vision for the motorcyclist, whilst protecting the motorcyclist's face from rain and the impact of debris, such as flying insects, whilst in motion.

The fluid delivery device may include a wicking material arranged in contact with both the fluid reservoir and the absorbent cleaning element. The wicking material may be part of the absorbent cleaning element. Alternatively, the wicking material may be a separate component to the absorbent cleaning element. The wicking material may be arranged inside a conduit connecting the fluid reservoir to the absorbent cleaning element. The wicking material may be the same material as the absorbent cleaning element. Alternatively, the wicking material may be of a different material than the absorbent cleaning element. The wicking material may be used to ensure capillary action of fluid transfer between the fluid reservoir and the absorbent cleaning element.

The absorbent cleaning element may be made of cellulose sponge. Cellulose sponge is biodegradable and can hold fluid up to 20 times it own volume. The wicking material may be made of cellulose sponge. Alternatively, the wicking material may be made of polyvinyl alcohol (PVA) sponge. The advantage of using PVA sponge as the wicking material is that the PVA sponge is less degradable and is less likely to need to be replaced than the absorbent cleaning element because the wick generally will be enclosed in a conduit and will not be exposed to debris etc. The absorbent cleaning element may be made of eco-friendly material, cellulose sponge being one example. The absorbent cleaning element may be a consumable item because in use it is likely to become worn and/or contaminated with debris and it s performance may degrade. As such, disposal of a depleted absorbent cleaning element is easier if the material is eco-friendly.

The wicking material may be made of absorbent material, for example sponge, that may have relatively high absorption rate.

The cleaning element may be made of absorbent material, for example sponge that may have a relatively low evaporation rate.

The cleaning element may be made of absorbent material that may have a lower absorption rate than the absorption rate of the wicking material.

The fluid delivery device may include a movable shield element that may be arranged as a protective cover operable to protect the absorbent cleaning element prior to and after use. The shield may reduce evaporation of fluid from the cleaning element. The shield may prevent ingress of debris to the cleaning element prior to use.

The shield may be arranged such that on the action of the user to clean the visor the shield moves automatically to expose the cleaning element. Movement of the shield to expose the absorbent cleaning element may be by a substantially sweeping action of the user's hand against the visor. The shield may be hingedly attached to the fluid delivery device adjacent to the cleaning element. Movement of the shield may be about a hinge to expose the absorbent cleaning element. The movement may be by a substantially sweeping action of the user's hand against the visor.

The shield may be made of waterproof or substantially impermeable material. The shield may include at least a layer of waterproof or substantially impermeable material at a face adjacent to the cleaning element.

The fluid delivery device may include one or more wiping members adapted, in use, to wipe excess fluid or debris from the visor. The wiping member may be arranged to lead and/or trail the absorbent cleaning member as the cleaning member is swept across the visor. The wiping member may be in the form of a wiper blade that is operable to scrape excess fluid from the visor. One or more wiping members may be provided on or adjacent to the shield. One or more wiping members may be provided on the external surface of the shield. A wiping member may also provide a seal against the shield such that a physical action by the user may be required to unseal and move the shield to expose the absorbent cleaning element. The seal may be configured to eliminate or reduce evaporation from the cleaning element when covered by the shield.

A wiping member external to the shield may allow for quick removal of, for example rainwater from the visor where it is not deemed necessary to apply cleaning fluid. The use of a wiping member on its own to remove rain water may reduce smearing compared with wiping with a damp glove.

The wiping member may be arranged such that the single sweeping action described above is operable to apply cleaning fluid to the visor from the cleaning element and also to remove excess fluid from the visor. The wiping member may be arranged to lead or trail the action of the cleaning element. The wiping member may be made of flexible impermeable material, for example rubber or a polymeric material.

The fluid delivery device may include an isolating member that may be arranged to allow or prevent permanent fluid communication between the fluid reservoir and the absorbent cleaning member. The isolating member may be a clamping member operable to clamp at least part of a conduit that extends between the reservoir and the cleaning element to cut off permanent fluid communication between the fluid reservoir and the absorbent cleaning member.

In use, the fluid delivery device may include the fluid reservoir and the absorbent cleaning element arranged on the dorsal aspect of a user's hand. The reservoir may be positioned in a region close to the cuff of a glove or wrist of the user. The reservoir may be positioned on the hand such that permanent fluid communication is provided by gravity feed of fluid from the reservoir to the cleaning element. The position or arrangement of the reservoir relative to the position of the absorbent cleaning element and the position of the user's hand on the handle bars of the motorcycle may provide feed of fluid by gravity to the absorbent cleaning element.

The absorbent cleaning element may be arranged adjacent the user's thumb. Arranging the cleaning element adjacent the user's thumb allows the user to apply more force in the cleaning action and also provides a larger surface area and hence a larger cleaning element can be used. Alternatively, in use, the fluid the absorbent cleaning element may be arranged adjacent the user's index finger.

The fluid delivery device may include a drying member. The drying member may be arranged on an alternative digit to that of the absorbent cleaning element. Alternatively, a drying member may be applied to a region on the back of the user's hand. The drying member may be made of any suitable quick drying material. For example the drying member may be made of conventionally known microfiber material. Alternatively, the drying material may be made of chamois leather or synthetic chamois materials.

The fluid delivery device may be adapted to be retrofit to the rear of glove and one or more digits of a glove. Alternatively, the fluid delivery device may be incorporated in an overlay for a glove. The overlay may be retrofit to a glove. Alternatively, the fluid delivery device may be manufactured as part of a glove.

A second aspect of the present invention provides a fluid delivery device to be worn on a user's hand for a visor cleaner, the fluid delivery device comprising:

- a fluid reservoir adapted, in use, to contain fluid;
- an absorbent cleaning element arranged to absorb fluid from the fluid reservoir;
- wherein the fluid is in automatic communication with the absorbent cleaning element, regardless of the actions of the user.

Automatic fluid communication may be due to gravity feed of fluid from the reservoir to the absorbent cleaning element. Automatic fluid communication may be by capillary action between the fluid in the reservoir and the absorbent cleaning element. Capillary action may be by use of a wick forming part of the absorbent cleaning element or a wick separate from the absorbent cleaning element, but where the wick is at least partially immersed in fluid contained in the reservoir.

A third aspect of the present invention provides a fluid delivery device to be worn on a user's hand for a visor cleaner, the fluid delivery device comprising:

- a fluid reservoir adapted, in use, to contain fluid;
- an absorbent cleaning element in fluid communication with fluid in the reservoir; and
- a fluid delivery element arranged, in use, between an index finger and a thumb of a hand such that transfer of fluid from the fluid reservoir to the absorbent cleaning element is by one or more presses of the thumb.

The third aspect of the present invention therefore relates to a fluid delivery device that is suitable for cleaning a motorcycle helmet visor in a single sweeping action across the visor. Fluid delivery to the absorbent cleaning element can be done whilst the users hand is gripping the handle bar due to the simple action of one or more presses of the thumb against the side of the index finger. After priming the cleaning element with cleaning fluid, the user can confidently remove his grip of the handle bar and in a single sweeping motion the cleaning element can efficiently and quickly clear the visor of debris.

In use, the absorbent cleaning element of the fluid delivery device of the third aspect of the invention may be arranged or located on the back of or the side of the index finger.

According to the third aspect of the present invention, the fluid delivery element may comprise a unidirectional valve and a pump member such that transfer of fluid from the fluid reservoir to the absorbent cleaning element by a one or more presses of the thumb allows fluid transfer in one direction only; namely in the direction of the absorbent cleaning element.

The pump member may include a bellow type arrangement. Therefore, the action required by the thumb requires minimal movement of the thumb.

The fluid delivery device according to first, second and third aspects of the present invention may be operable to clean a visor of a motorcycle helmet.

The fluid delivery device according to first, second and third aspects of the present invention may be included in a glove, as retrofit to a glove or as part of an outer layer to be applied to a glove.

The fluid delivery device according to first, second and third aspects of the present invention may be included as part of an outer garment that may have at least a thumb portion and/or an index finger portion.

The fluid delivery device according to the first, second and third aspects of the present invention may include an auxiliary reservoir adapted to be in fluid communication with the reservoir of the fluid delivery device. The auxiliary reservoir may be arranged to provide fluid to the reservoir of the fluid delivery device to ensure that supply of fluid to the cleaning device is less likely to run out, which may occur on longer journeys and in extreme conditions, for example winter weather when roads are heavily salted.

Fluid transfer from the auxiliary reservoir and the reservoir of the fluid delivery device may be automatic. The fluid transfer from the auxiliary reservoir and the reservoir of the fluid delivery device may be by gravity. Alternatively, fluid transfer from the auxiliary reservoir to the reservoir of the fluid delivery device may be by a pump and unidirectional valve arrangement.

An outer garment incorporating the fluid delivery device according to first and second aspects of the present invention may be made of flexible material. For example an outer layer may be made of neoprene.

The second and third aspects of the present invention may include features in common as defined in the first aspect, for example the features of the fluid reservoir, the absorbent cleaning element, the shield element and the one or more wiping members.

BRIEF DESCRIPTION OF THE DRAWINGS

Embodiments of the invention are further described hereinafter with reference to the accompanying drawings, in which.

DETAILED DESCRIPTION

Figures 1A, 1B:
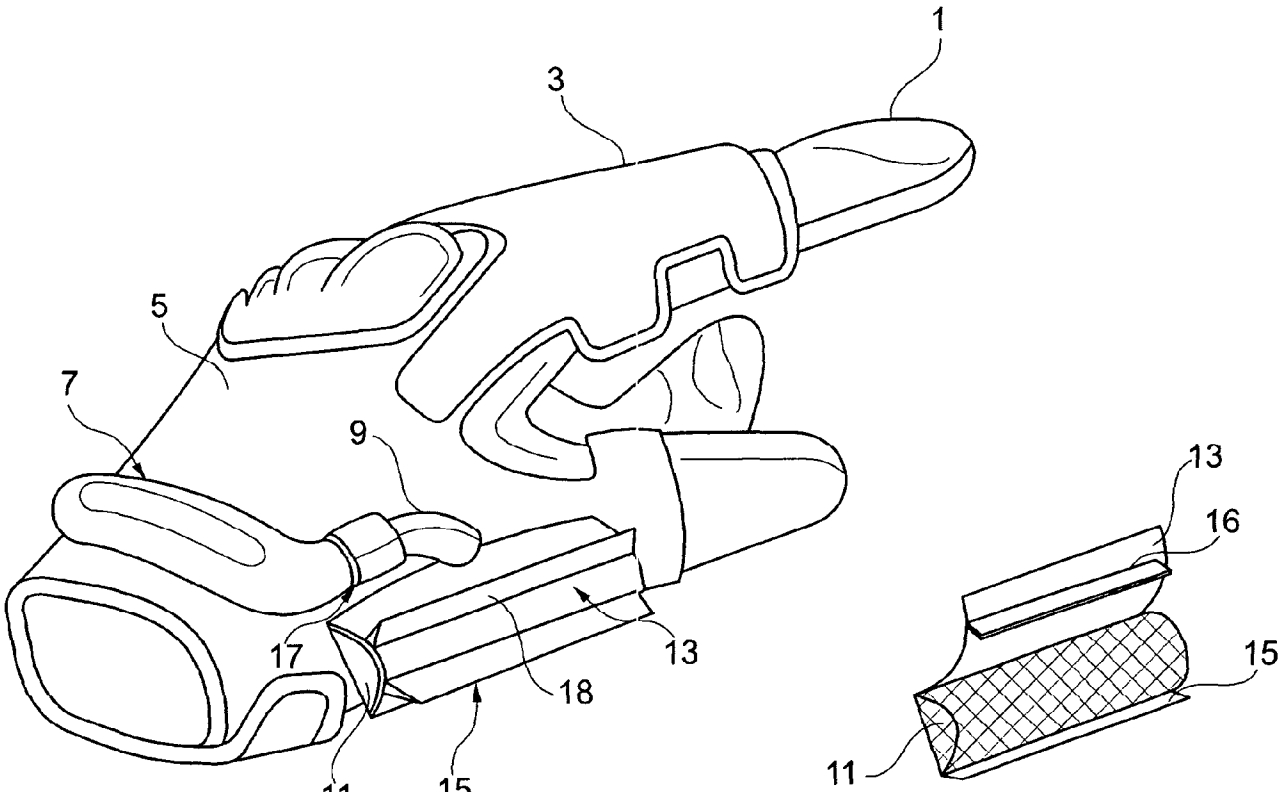
FIG. 1*a* is a diagrammatic representation of a fluid delivery device according to an embodiment of the present invention.
FIG. 1*b* is a diagrammatic representation of the arrangement of a cleaning element and an active shield of the fluid delivery device of FIG. 1*a;*

Whilst the description that follows is directed to the use of the fluid delivery device by motorcyclists to clean the visor on a crash helmet, it will be appreciated that further applications of the device are included also, for example the fluid delivery device is applicable to users of eye protection, for example in motor sports or paintballing.

Referring to FIG. 1 *a*, there is illustrated a representation of a motorcycle protective glove 1 for a hand and a visor cleaning device in the form of a fluid delivery device 3 according to an embodiment of the present invention. In the embodiment illustrated, the fluid delivery device 3 is shown as part of an overlay or secondary skin 5 that may be worn by the user, for example a motorcyclist, over the top of a conventional motorcycle protective glove 1.

The fluid delivery device 3 comprises a reservoir 7 and an absorbent cleaning element 11. In use, the reservoir 7 contains cleaning fluid that passes to the cleaning element via a conduit 9 that extends between the reservoir 7 and the cleaning element 11. The cleaning element 11 is made of absorbent material. The cleaning element 11 may have a surface abrasion quality that allows debris to be removed from the visor quickly and efficiently. The abrasive quality of the cleaning element 11 must be such that it cleans without scratching or marking the visor. An example of suitable material is cellulose sponge. Cellulose sponge is an eco-friendly material, which means that when the cleaning element 11 becomes worn or dirty it can be replaced and disposed of easily. Cellulose sponge is highly absorbent and can hold fluid that is up to twenty times its volume.

Figure 2:
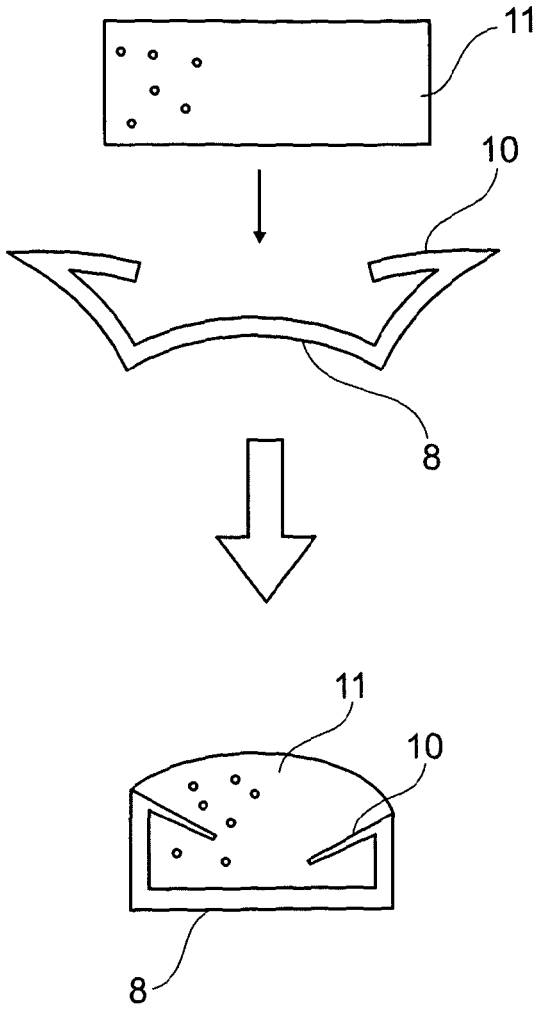
FIG. 2 is a diagrammatic representation of replacement of the cleaning element of the fluid delivery device according to an embodiment of the present invention.

Referring to FIG. 2, the cleaning element 11 is arranged to be replaceable such that when the quality of the cleaning element 11 has degraded the user can simply replace it. The cleaning element 11 may be secured in a flexible channel 8 that includes teethed sides 10 that flex outwardly to release the cleaning element 11 and grip the cleaning element 11 when it is placed in the channel 8.

Referring to FIG. 1*a* and FIG. 1*b*, the cleaning element 11 is shown protected by a shield 13. The shield 13 covers the cleaning element 11 when not in use to reduce evaporation of cleaning fluid from the cleaning element 11 and also to reduce the risk of the cleaning element 11 drying out. The shield 13 may be hinged to the flexible channel 8. FIG. 1*b* illustrates the shield 13 being pulled back to expose the cleaning element 11.

The shield 13 is made from substantially impermeable material such as rubber. The shield 13 acts to minimise evaporation of cleaning fluid from the cleaning element 11 and also prevents unwanted debris, such as flies coming into contact with the cleaning element 11 prior to use for cleaning. Accordingly, the cleaning element 11 is protected against contamination until it is required for cleaning the visor.

The fluid delivery device 3 also includes at least one wiper blade 15. The wiper blade 15 is used to remove excess fluid or debris from the visor. The wiper blade 15 also doubles as a lock to secure the shield 13 in place prior to use and as a seal to keep evaporation of fluid from the cleaning element 11 to a minimum. The shield 13 is locked against movement and sealed by interaction of the edge of the shield 13 with the wiper blade 15. In use, one or more wiper blades 15, 16, 18 can be arranged such that the action of the wiper blades 15, 16, 18 lead and/or trail the action of the cleaning element 11. In the illustrated embodiment, a wiper blade 16 is provided on the inside of the shield (see FIG. 1*b*) which acts as a trailing wiper blade to remove excess fluid in a single sweeping action across the visor. A wiper blade 18 is also shown on the outside surface of the shield 13. The wiper blade 18 acts to remove rainwater, for example, from the surface of the visor without needing to use the cleaning element 11.

The fluid delivery device 3 is arranged such that a single sweeping action of the cleaning element 11 against the visor moves the shield 13 to expose the cleaning element 11. The fluid communication between the absorbent cleaning element 11 and the fluid reservoir 7 means that the cleaning element 11 is always primed and ready for use. A single sweeping action of the hand across the visor with the cleaning element 11 in contact with the visor surface is therefore effective in applying cleaning fluid to the visor, effective in removing unwanted debris from the visor and effective in removing any excess fluid or debris from the visor due to the trailing action of the wiper blade 16.

When the fluid delivery device 3 is in use, the fluid reservoir 7 and the cleaning element are in permanent fluid communication. Permanent fluid communication means that fluid is transferred from the reservoir 7 to the cleaning element 11 regardless of the action of the user. In other words, transfer of fluid from the reservoir 7 to the cleaning element 11 is automatic.

The transfer of fluid between the fluid reservoir 7 and the cleaning element 11 may be by capillary action. The transfer of fluid, by capillary action, may be improved by the inclusion of a wick 14 in the conduit 9 between the reservoir 7 and the cleaning element 11. The wick 14 is made of absorbent material and is arranged to be in contact with fluid contained within the reservoir 7 and in contact with the absorbent cleaning element 11. The wick 14 may be part of the cleaning element 11 or it may be a separate part. In the illustrated embodiment the wick 14 is a separate part that is contained in the conduit 9. The wick 14 acts as the transfer medium from the reservoir 7 to the cleaning element 11. The wick 14 may be made of any absorbent material. The wick 14 is less likely to be replaced than the cleaning element 11. Therefore, a more robust and less degradable sponge is likely to perform better for longer as a wick material than an eco-friendly material. An example of suitable wicking material is PVA sponge.

Transfer of fluid from the reservoir 7 to the cleaning element 11 may be due to gravity. The position of the reservoir 7 and the position of the cleaning element 11 relative to the reservoir 7 when positioned on the users hand allows fluid to flow due to gravity from the reservoir 7 to the cleaning element 11.

A closure member is included on the conduit 9 and acts to close the fluid path between the reservoir 7 and the cleaning element 11. The closure member may be a clamp 17 operable to squeeze the conduit 9 to prevent fluid flow or transfer. The inclusion of the clamp 17 may prevent leakages from the cleaning element 11 and therefore unnecessary loss of cleaning fluid, when the device is not in use. In particular, the clamp 17 is useful when the device is being stored out of use. The clamp 17 is manually operated such that the user can open and close the flow path as required.

Figure 3:
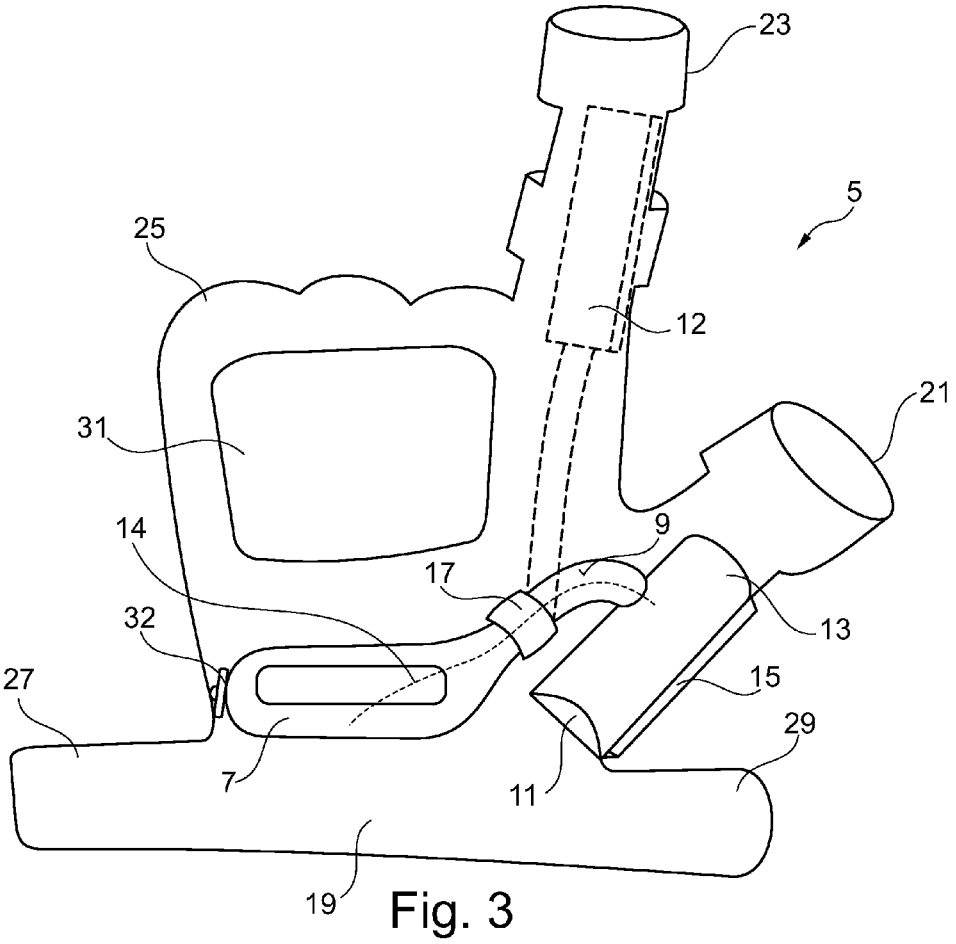
FIG. 3 is a diagrammatic representation of a dorsal aspect of a fluid delivery device according to an embodiment of the present invention.

Referring to FIG. 3, a glove overlay or secondary skin 5 is illustrated. The glove overlay 5 is shown in the dorsal aspect because it will be worn on the left hand of the user and mainly across the back of the user's left hand or left-handed glove. In the illustrated embodiment, the glove overlay 5 includes a cuff portion 19, a thumb portion 21, an index finger portion 23 and a dorsal portion 25; the dorsal portion is the main body of the overlay 5 and the part of the overlay that covers the back of the users hand or glove when worn. The cuff portion 19 is shown to comprise two straps 27, 29 that wrap around the wrist of the user or the cuff of a protective glove to secure the glove overlay when in use. The straps may include an element of elasticity and may be closed in a conventional manner such as using Velcro™ or a combination of D rings and straps such that the glove overlay 5 is secure.

The thumb portion 21, the index finger portion 23 and the dorsal portion 25 may include fixing straps or possible elastic straps to ensure a comfortable and secure fit of the overlay glove when worn. The dorsal portion 25 of the glove overlay includes an aperture 31, which is arranged to fit around the reinforced knuckle region of a motorcyclist's protective glove.

In the embodiment illustrated in FIG. 3, the cleaning element 11, the shield 13 and the wiper blade 15 are arranged on the thumb portion 21 of the glove overlay 5. It will be appreciated that the cleaning element 11, the shield 13 and the wiper blade 15 may alternatively be attached to the index-finger portion 23 as indicated by reference numeral 12 and is shown in dashed lines in FIG. 3.

Figure 4:
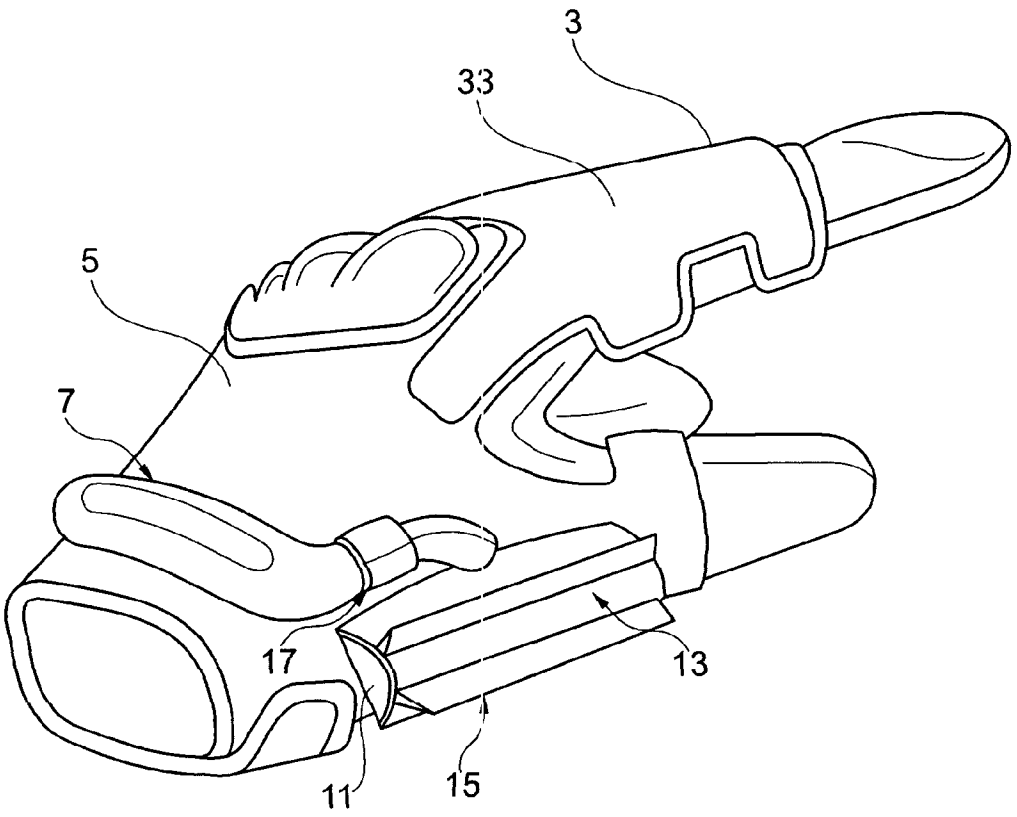
FIG. 4 is a diagrammatic representation of a fluid delivery device of FIG. 1 comprising an additional cleaning component.

Referring to FIG. 4, the glove overlay 5 may include a cleaning or drying cloth 33 that may be attached by conventional means such as Velcro™ to the rear of the index finger.

The cleaning element 11 and the cleaning or drying cloth 33 are arranged to be consumable items that that can be easily replaced when dirty or in bad condition.

It will be appreciated that the fluid delivery device may be retrofit to a glove by directly attaching the reservoir 7, conduit 9 and cleaning element 11 to the rear of a glove. Alternatively, the fluid delivery device may be incorporated into the manufacture of a motorcyclist's protective glove.

Figure 5A:
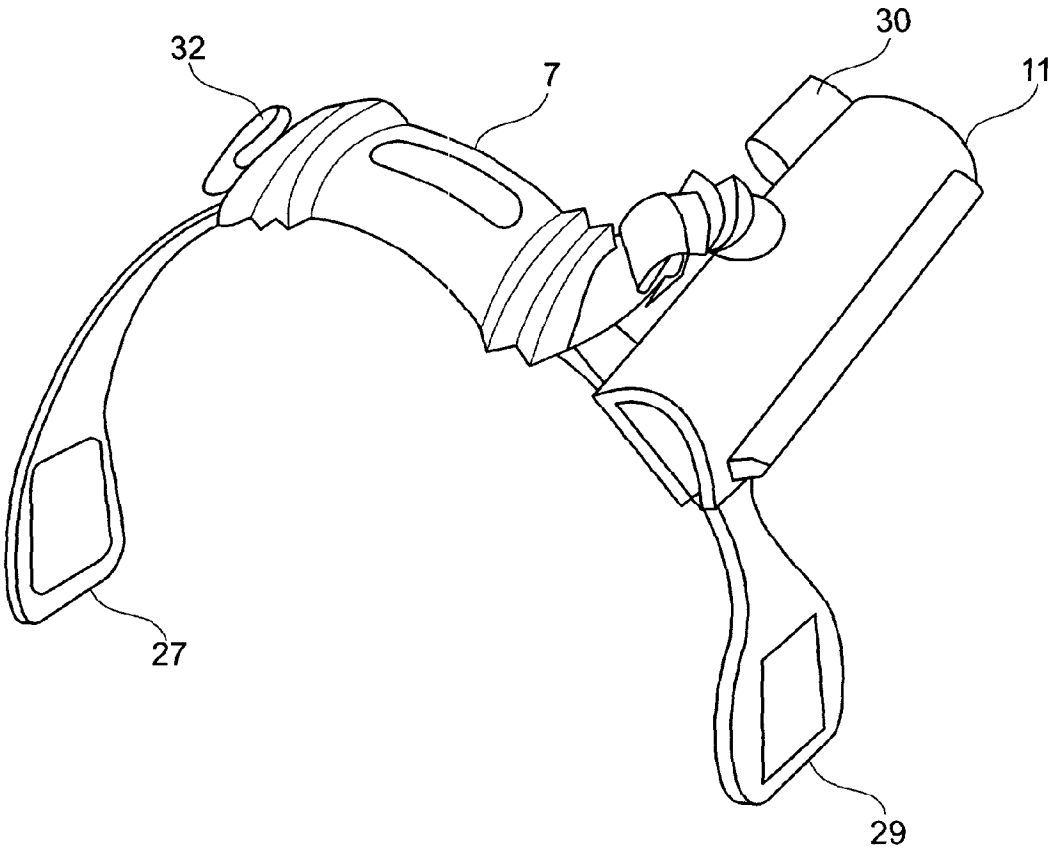
FIG. 5*a* is a diagrammatic representation of a fluid delivery device according to an embodiment of the present invention.
Figure 5B:
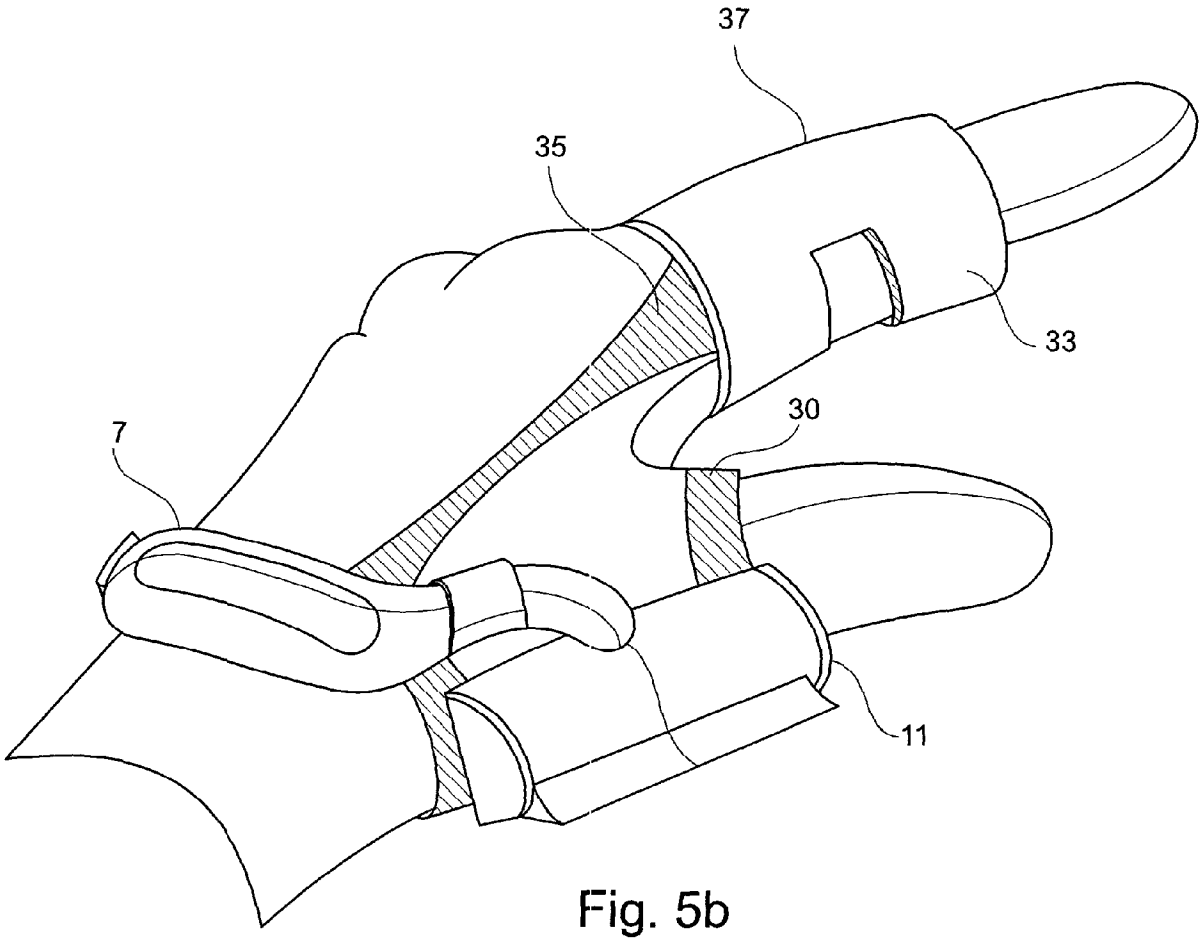
FIG. 5*b* is a diagrammatic representation of a fluid delivery device of FIG. 5*a* comprising an additional cleaning component.

An alternative retrofit arrangement is illustrated in FIG. 5*a*. The reservoir 7 and cleaning element 11 form a portable unit that is attached to wrist straps 27, 29 and a thumb strap 30. The thumb strap 30 may be an elastic loop for comfort. FIG. 5*b* illustrates the addition of a finger portion 37 that includes an optional cleaning cloth 33 and extension strap 35 that extends along the back of the user's hand. The finger portion 37 may include an elastic loop for comfortable attachment to the user's finger.

Figure 6:
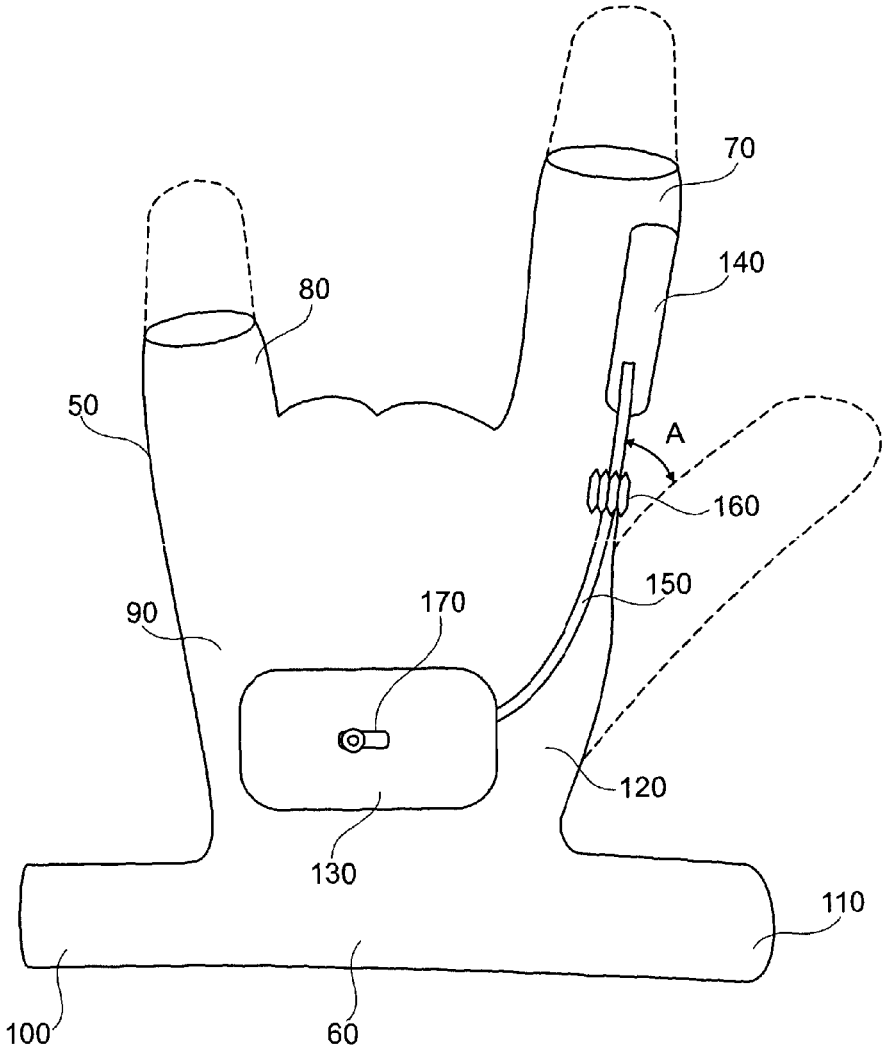
FIG. 6 is a diagrammatic representation of a fluid delivery device according to an embodiment of a third aspect of the present invention.

Referring to FIG. 6, an embodiment of a further aspect of the invention is illustrated. A glove overlay 50 is illustrated.

The glove overlay 50 is shown in the dorsal aspect because it will be worn on the left hand of the user and mainly across the back of the user's left hand or left-handed glove.

In the illustrated embodiment, the glove overlay 50 includes, a cuff portion 60, an index finger portion 70, a little finger portion 80 and a dorsal portion 90; the dorsal portion 90 is the main body of the overlay 50 that covers the back of the user's hand or glove when worn.

The cuff portion 60 is shown to comprise two straps 100, 110 that wrap around the wrist of the user or the cuff of a protective glove worn by the user to secure the glove overlay 50 when in use. The straps 100, 110 may be elastic and may be secured around the wrist in a conventional manner such as using Velcro™ or a combination of D rings, straps and Velcro™.

A fluid delivery device 120 is illustrated and comprises a fluid reservoir 130, a cleaning element 140, a conduit 150 and a pumping device 160. The pumping device 160 is located in the glove overlay 50 in a region that when worn pressing the thumb against the inside of the index finger (as indicated by arrow A) will push fluid from the fluid reservoir 130 to the cleaning element 140. As with the embodiment described above with reference to FIGS. 1 to 5*b*, the cleaning element 140 of the embodiment illustrated in FIG. 6 may also include a substantially impermeable shield and one or more wiper blades. In the embodiment illustrated in FIG. 6 the cleaning element 140 is located on the index finger portion of the glove overlay 50.

In the embodiments described with reference to FIGS. 1 to 4 and FIG. 6, the glove overlay 50 may be manufactured from an open structured fabric such as mesh, which may include some elastic properties to ensure a snug secure fit against the users hand or a glove worn by the user. The digit portions may be in the form of tunnels of elastic material to ensure a snug and comfortable fit for the user.

In each of the embodiments described the fluid reservoir 7, 130 may be refillable and as such may include a filler cap 32, 170.

It will be appreciated, that in the embodiment illustrated that the visor cleaning device is retrofit to an existing glove 1. However, it will also be appreciated by the above description that the features of the fluid delivery device may be incorporated in a protective glove during manufacture. Alternatively, the components of the fluid delivery device of the embodiments described may be retrofit directly to a glove in the absence of the secondary skin 5.

The capacity of the fluid reservoir 7, 130 may be around 10 milliliters of cleaning fluid, which allows for a compact size and also provides enough cleaning fluid for typical day-to-day journeys.

Figure 7:
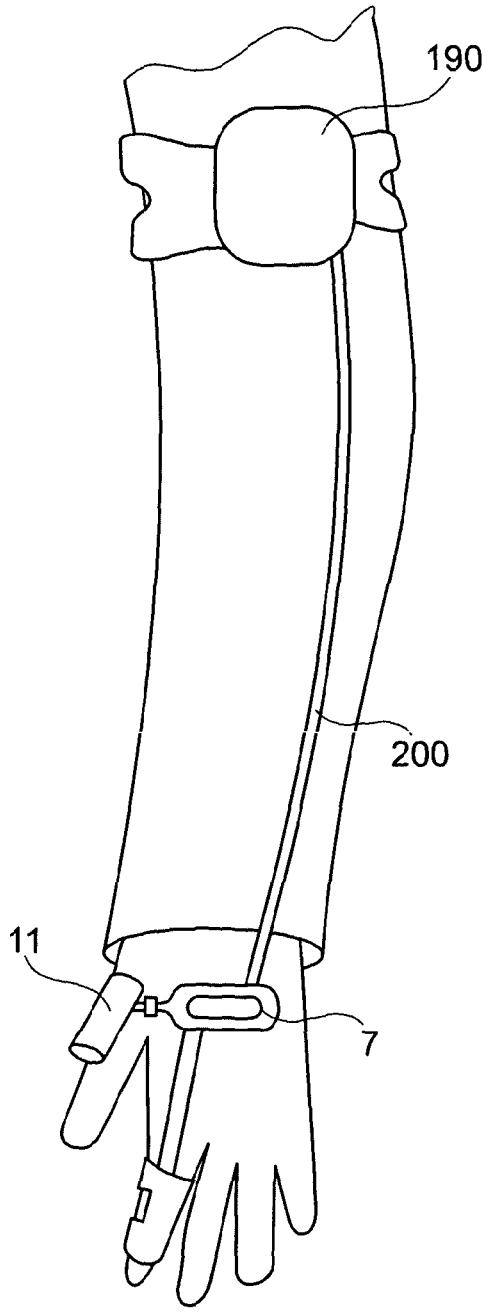
FIG. 7 is a diagrammatic representation of an auxiliary reservoir adapted for use with the fluid delivery device as shown in FIGS. 1 to 6.

The fluid delivery device arrangement illustrated in FIG. 7 includes an additional reservoir, hereinafter an auxiliary reservoir 190, which can be used with the fluid delivery device according to any of the embodiments described above for use on longer journeys. FIG. 7 illustrates the auxiliary reservoir 190 connected to the fluid delivery device as illustrated in FIG. 5*b*.

In extreme weather conditions the road surface may be heavily salted or even particularly dirty due to the traffic. This can result in a lot of spray from wheels and also a lot of debris being thrown up onto the visor of a motorcyclist's helmet. In such extreme conditions the motorcyclist may need to clean their visor in excess of one hundred times. Such use of the fluid contained in the reservoir 7, 130 of the fluid delivery device would quickly empty the reservoir 7, 130.

The purpose of the auxiliary reservoir 190 is to allow the user to have access to a increased quantity of fluid, but without affecting the portability and the versatility of the reservoir 7, 130 that is part of the fluid delivery device.

In the example illustrated in FIG. 7, the auxiliary reservoir 190 is a flexible pouch that is connected to the fluid reservoir 7, 130 of the fluid delivery device by flexible tubing 200. The auxiliary reservoir 190 may be strapped to the users arm either above or below the elbow and is arranged such that the flexible tubing runs down the inside of the user's sleeve and exits at the cuff for connection to the fluid reservoir 7, 130. Alternatively, the auxiliary reservoir 190 could be attached to an item of clothing or contained in a pocket on the clothing.

Rather than being worn about the person's body, the auxiliary reservoir 190 may be connected to the motorcycle, for example the handle bars.

The fluid capacity of the auxiliary reservoir 190 may be dependent on the length of the journey. In the example illustrated the capacity of the auxiliary reservoir is in the region of about 50 to 100 milliliters, but could be more or less than this depending on the journey.

Fluid transfer from the auxiliary reservoir 190 to the reservoir 7, 130 is by gravity, such that there is permanent, unhindered fluid communication between the reservoir 7, 130 and the auxiliary reservoir 190. Alternatively, or in addition, the auxiliary reservoir 190 may include a pump and unidirectional valve arrangement to assist fluid transfer from the auxiliary reservoir 190 to the reservoir 7, 130 of the fluid delivery device.

While the invention has been shown and described with reference to certain exemplary embodiments, it will be understood by those skilled in the art that various changes in form and details may be made therein without departing from the scope of the invention as defined by the appended claims and their equivalents.

The invention claimed is:

1. A fluid delivery device for a visor cleaner, the fluid delivery device comprising:

a fluid reservoir;

an absorbent cleaning element arranged to absorb fluid from the fluid reservoir;

wherein the absorbent cleaning element is adapted to be in permanent fluid communication with fluid contained in the fluid reservoir;

a movable shield adapted to cover the absorbent cleaning element prior to and after use, wherein the shield is movable by a sweeping action to expose the cleaning element; and a wiper blade as part of the movable shield and being arranged to trail the action of the cleaning element such that a single sweeping action of the movable shield against a surface to be cleaned is operable to move the shield to expose the absorbent cleaning element such that cleaning fluid can be applied to the surface and the trailing action of the wiper blade is operable to remove excess fluid from the surface.

2. The fluid delivery device according to claim 1, wherein fluid transfer from the reservoir to the absorbent cleaning element is by capillary action.

3. The fluid delivery device according to claim 2, further comprising a wicking member in communication with both the fluid in the reservoir and the absorbent cleaning element.

4. The fluid delivery device according to claim 1, wherein movement of the shield is about a hinge to expose the absorbent cleaning element, wherein the movement is by a substantially sweeping action of the fluid delivery device against the visor.

5. The fluid delivery device according to claim 1, further comprising one or more wiping blades, wherein the one or more wiping blades are arranged on or are arranged adjacent to the movable shield.

6. The fluid delivery device according to claim 1, wherein the absorbent cleaning element is cellulose sponge.

7. The fluid delivery device according to claim 1, adapted to retrofit to a rear of a glove.

8. The fluid delivery device according to claim 1, further comprising a glove.

9. The fluid delivery device according to claim 1, wherein the fluid reservoir and the absorbent cleaning element are adapted to be arranged on the dorsal aspect of a user's hand.

10. The fluid delivery device according to claim 1, wherein the absorbent cleaning element is adapted to be arranged adjacent to a user's thumb.

11. The fluid delivery device according to claim 1, wherein the absorbent cleaning element is adapted to be arranged about or adjacent to a user's index finger.

12. The fluid delivery device according to claim 1, further comprising an external reservoir arranged in fluid communication with the fluid reservoir of the fluid delivery device.

13. The fluid delivery device according to claim 1 operable to clean a visor of a motorcycle helmet.

14. A fluid delivery device for a visor cleaner, the fluid delivery device comprising:

a fluid reservoir;

an absorbent cleaning element adapted to absorb fluid from the fluid reservoir, wherein the absorbent cleaning element is adapted to be in automatic communication with fluid in the fluid reservoirs, a movable shield adapted to cover the absorbent cleaning element prior to and after use, wherein the shield is movable by a sweeping action to expose the cleaning element; and a wiper blade being arranged to trail the action of the cleaning element such that a single sweeping action of the movable shield against a surface to be cleaned is operable to move the shield to expose the absorbent cleaning element such that cleaning fluid can be applied to the surface and the trailing action of the wiper blade is operable to remove excess fluid from the surface.

15. A glove comprising the fluid delivery device of claim 14.

* * * * *

UNITED STATES PATENT AND TRADEMARK OFFICE

CERTIFICATE OF CORRECTION

PATENT NO. : 9,198,554 B2
APPLICATION NO. : 13/991639
DATED : December 1, 2015
INVENTOR(S) : Boulton et al.

It is certified that error appears in the above-identified patent and that said Letters Patent is hereby corrected as shown below:

On the title page, item (54) and in the specification, column 1, line 1, change

"FLUID DELIVERY SERVICE" to --FLUID DELIVERY DEVICE--.

Signed and Sealed this
Twenty-ninth Day of March, 2016

Michelle K. Lee

Michelle K. Lee
*Director of the United States Patent and Trademark Office*